US008733222B2

(12) United States Patent
Borel et al.

(10) Patent No.: US 8,733,222 B2
(45) Date of Patent: May 27, 2014

(54) DEVICE FOR FEEDING A CONVERTING UNIT WITH A WEB SUBSTRATE FOR A FEEDING STATION IN A PACKAGING PRODUCTION MACHINE

(75) Inventors: Edouard Borel, Dommartin (CH); Philippe Clement, Penthalaz (CH); Yeznig Maghdessian, Corminboeuf (CH)

(73) Assignee: Bobst Mex SA (CH)

( * ) Notice: Subject to any disclaimer, the term of this patent is extended or adjusted under 35 U.S.C. 154(b) by 214 days.

(21) Appl. No.: 13/132,972

(22) PCT Filed: Nov. 6, 2009

(86) PCT No.: PCT/EP2009/007960
§ 371 (c)(1),
(2), (4) Date: Jun. 6, 2011

(87) PCT Pub. No.: WO2010/063353
PCT Pub. Date: Jun. 10, 2010

(65) Prior Publication Data

US 2011/0239598 A1 Oct. 6, 2011

(30) Foreign Application Priority Data

Dec. 4, 2008 (EP) ..... 08021034

(51) Int. Cl.
*B26D 3/08* (2006.01)
*B65H 20/00* (2006.01)

(52) U.S. Cl.
USPC ..... 83/879; 83/436.6; 226/181

(58) Field of Classification Search
USPC ..... 83/879, 236, 436.6, 436.15; 226/114, 226/154, 155, 181
See application file for complete search history.

(56) References Cited

U.S. PATENT DOCUMENTS

| | | | | |
|---|---|---|---|---|
| 3,667,354 | A | 6/1972 | Steinmetz | |
| 3,892,344 | A | 7/1975 | Corse | |
| 4,060,187 | A * | 11/1977 | Grob | 226/8 |
| 4,147,079 | A * | 4/1979 | Ihle | 83/170 |

(Continued)

FOREIGN PATENT DOCUMENTS

| | | |
|---|---|---|
| CH | 292425 A | 8/1953 |
| CH | 618660 A5 | 8/1980 |

(Continued)

OTHER PUBLICATIONS

International Search Report dated Feb. 15, 2010, issued in corresponding international application No. PCT/EP2009/007960.

*Primary Examiner* — Omar Flores Sanchez
(74) *Attorney, Agent, or Firm* — Ostrolenk Faber LLP

(57) ABSTRACT

A device for feeding a converting unit with a web substrate, the converting unit converting the substrate when stopped. The device includes a main drive roller rotating on a main shaft a main electric drive motor (14) rotating (T) the main roller (12), a satellite roller oscillating about the main roller (12), between upstream and downstream on the path of a substrate. Two lateral levers secured to the main shaft hold the satellite roller and are mounted on the main shaft. The substrate is maintained between the main and satellite rollers to change cyclically between a constant speed to a zero speed at the exit side of the satellite roller. At least one secondary electric drive motor oscillates the main shaft, the two lateral levers and the satellite roller.

13 Claims, 2 Drawing Sheets

(56) References Cited

U.S. PATENT DOCUMENTS

| | | | | |
|---|---|---|---|---|
| 4,244,504 | A | 1/1981 | Grob et al. | |
| 4,863,086 | A | 9/1989 | Armelin | 226/152 |
| 5,685,472 | A | 11/1997 | Borel | |
| 6,749,098 | B2 | 6/2004 | Roier et al. | 226/34 |
| 7,404,349 | B1 * | 7/2008 | Fiske et al. | 83/236 |
| 2002/0195515 | A1 | 12/2002 | Roier et al. | |

FOREIGN PATENT DOCUMENTS

| | | | |
|---|---|---|---|
| EP | 0742170 | A | 11/1996 |
| EP | 1270472 | A | 1/2003 |
| LU | 69136 | A1 | 5/1974 |

* cited by examiner

DEVICE FOR FEEDING A CONVERTING UNIT WITH A WEB SUBSTRATE FOR A FEEDING STATION IN A PACKAGING PRODUCTION MACHINE

CROSS-REFERENCE TO RELATED APPLICATIONS

The present application is a 35 U.S.C. §§371 national phase conversion of PCT/EP2009/007960, filed Nov. 6, 2009 which claims priority of European Application No. 08021034.7, filed Dec. 4, 2008, the contents of which are incorporated by reference herein. The PCT International Application was published in the French language.

BACKGROUND OF THE INVENTION

The present invention relates to a device for feeding a converting unit with a web substrate. The invention also relates to a station for feeding a converting unit with a web substrate, the converting unit converting the substrate when stopped. Such a station comprises a feeding device according to the present invention. Such an unit for converting the substrate is a diecutting platen press or else a printing platen. The invention finally relates to a packaging production machine incorporating a feeding station with a web substrate and a subsequent unit for converting the substrate.

A packaging production machine is designed for the manufacture of boxes, which will be suitable for forming packages, by folding and gluing. In a packaging production machine, production begins with an initial continuous substrate, that is to say a virgin web, for example of cardboard, that is unwound continuously, printed by one or more printing units, optionally embossed, and then cut in a diecutting platen press.

The blanks or boxes obtained are then shingled before being stacked in rows in order to form stacks in a delivery and palletizing station for the purpose of storing them or conveying them out of the production machine.

A diecutting platen press or a printing platen is a converting unit that requires a momentary stopping of the progression of the substrate during the conversion. Because of the continuous feeding upstream, an accumulation of the substrate occurs in the form of an upstream loop.

A feeding station is used first of all for placing the printing in longitudinal and lateral register with the cutting. The other function of the feeding station is to create cyclically and to control this loop at all times which becomes longer during the stop due to the working of the press and which becomes shorter when the feeding of the press resumes for the purpose of the subsequent conversion. The feeding station transforms the continuous progression of the substrate into an intermittent progression, at each work cycle of the converting unit, while maintaining a constant tension of the substrate at the loop control.

DESCRIPTION OF THE PRIOR ART

In a feeding station, it is known to set up an arrangement leading the substrate around the circumference of an off center roller mounted between two rotary plates, as described for example in documents CH-602,462 and CH-618,660.

Also known, according to document EP-742,170 is a device for feeding a station with a substrate, the station working the substrate when stopped. This device comprises a first roller, called the drive roller, also known as the draw roll or feathering drive, around which there oscillates cyclically, to upstream and then to downstream, a second roller called the satellite roller. The satellite roller is mounted on two lateral levers pivoting on the axis of the drive roller. The pinion for driving the satellite roller meshes with a toothed wheel joined to the axle of the first drive roller. A connecting rod is coupled by means of a bearing to the axle of the satellite roller and allows pulling the latter cyclically from upstream to downstream.

This device also comprises a counterweight rotatably driven by a pinion from the toothed wheel of the axle of the first drive roller. The counterweight is mounted on an arm pivoting about the axle of the first drive roller. The counterweight is connected by a mechanism to the levers in order to cause the satellite roller to oscillate the reverse direction. The counterweight allows for compensation of the traction of the connecting rod on the axle of the satellite roller. The counterweight has moments of inertia, relative to its central rotation axle and relative to the axle of the arm, that are identical to those of the satellite roller.

However, such a device has the drawback of requiring the presence of an additional mechanism for connecting the platen to the connecting rod of the device. This mechanism slows down the feeding device as a whole. The presence of a counterweight confers a considerable inertia on the assembly having the satellite roller. In addition, losses of register occur between the inlet of the feeding station and the conversion by diecutting that follows, because of the many mechanical parts involved. These existing constructions lose their adjustment and also wear fairly quickly which leads to jams of the substrate in the feeding station and in the converting unit.

SUMMARY OF THE INVENTION

The main object of the present invention consists in developing a device for feeding a converting unit with a web substrate. A second object is to produce a device allowing higher speeds for the feeding of the substrate and for the subsequent conversion of the substrate. A third object is to make the longitudinal and lateral register of the substrate more accurate between the feeding and the conversion, thanks to a station comprising a feeding device. A fourth object is to conceive a device for a feeding station avoiding the problems of the prior art. Yet another object is to make a machine for producing packages incorporating a feeding station and a converting unit for the web substrate, converting the substrate in a discontinuous manner.

A device according to the invention is provided for feeding a converting unit with a web substrate. The converting unit transforms the web substrate when stopped. The device comprises:

- a main drive roller rotating on a main shaft,
- a main electric drive motor rotatably driving the main drive roller,
- a satellite roller able to oscillate about this main drive roller, from upstream to downstream, and vice versa from downstream to upstream, and
- two lateral levers holding the satellite roller, and mounted on this main shaft.

The web substrate is engaged and maintained between this main drive roller and this satellite roller. The web substrate changes cyclically from a constant speed to a zero speed, and vice versa from a zero speed to a constant speed, at the exit of the satellite roller.

According to one aspect of the present invention, the device is characterized in that the two lateral levers are joined to this main shaft. The device is also characterized in that it comprises at least one secondary electric drive motor able to oscillate the main shaft, the two lateral levers and the satellite roller.

In the whole of the description, the directions upstream and downstream are defined by reference to the direction of progression of the web substrate, along the longitudinal direction, before, inside and after respectively the feeding device, the feeding station, and the converting unit.

In other words, the mechanism with connecting rod of the prior art is replaced by one or more secondary motors. Relative to the document of the prior art, the counterweight is removed, which allows the reduction of the inertia of the satellite roller and of all the moving parts. The device has improved ergonomics requiring only slight maintenance of the moving parts. Because of the removal of many mechanical parts, the device and the station are less noisy and more reliable.

The device requires only a few adjustments, which prevents the web substrate from being spoiled. The job changes and all of the adjustments are carried out by control of the main motor and of the secondary motor or motors. Such a control notably allows changing the speed of movement of the web substrate, the frequency and the amplitude of the oscillations of the satellite roller. The data relating to these adjustments can be stored and easily recalled for the execution of identical jobs. As an example, the size adjustment is performed instantaneously by increasing or reducing the amplitude of the oscillations.

The web substrate undergoes an acceleration along the longitudinal direction and not transversely as in the documents of the prior art. Because of the compactness of the device, the length of the web substrate is reduced between the inlet of this device and the inlet of the converting unit. This allows reduction of the errors in positioning the web substrate both longitudinally and laterally. This also allows reduction of the aerodynamic phenomena occurring on the web substrate which interfere with its trajectory.

The feeding device is completely uncoupled from the converting unit which allows the control of its speed, its production rate, its size, etc., in a manner different from the converting unit and thus to obtain more flexibility of use.

In another aspect of the invention, a station for feeding a converting unit with a web substrate, the converting unit converting the substrate when stopped, is characterized in that it comprises a device having one or more of the technical features described below.

According to yet another aspect of the invention, a machine for producing packages is characterized in that it comprises a feeding station as described below, positioned upstream from a converting unit in the form of a diecutting platen press.

BRIEF DESCRIPTION OF THE DRAWINGS

The invention will be clearly understood and its various advantages and features will better emerge throughout the following description of the nonlimiting exemplary embodiment, with reference to the appended schematic drawings in which.

DETAILED DESCRIPTION OF THE PREFERRED EMBODIMENTS

Figure 1:
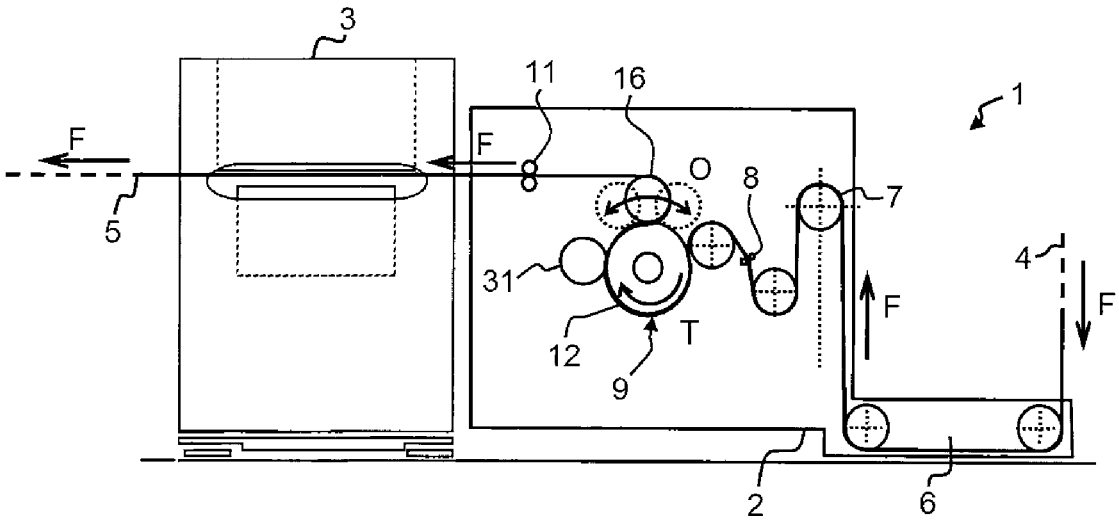
FIG. 1 shows a synoptic side view of a feeding station according to the invention, positioned upstream from a diecutting platen press.

As illustrated in FIG. 1, a packaging production machine (1) particularly comprises a feeding station (2) and a converting unit which, in this case, is a diecutting platen press (3). The packaging production machine (1) has, as an example, printing units as well as means for monitoring the quality and the register, upstream from the feeding station (2).

The feeding station (2) receives, upstream, a web substrate or material which, in this case, is cardboard (4), arriving at a constant speed. The feeding station (2) delivers this same web (4) to the platen press (3) downstream at an intermittent speed. The platen press (3) cuts the web (4) and delivers blanks (5). The direction of travel or of progression (arrow F in FIG. 1) of the web (4) and of the blanks (5) along the longitudinal direction indicates the upstream direction and the downstream direction.

So as to ensure that the press (3) operates optimally, the feeding station (2) may comprise, in order from upstream to downstream:

a lateral web guiding (6), used for correcting the lateral register of the web (4) if necessary;

a dancer roller (7) designed to keep the tension of the web (4) constant;

a web straightener (8) also known as a "decurler";

a "loop command" device (9) described in detail below; and a modulated infeed roller (11) able to regulate the tension of the web (4) and ensure the infeed of the web (4) at the inlet into the press (3).

Figure 2:
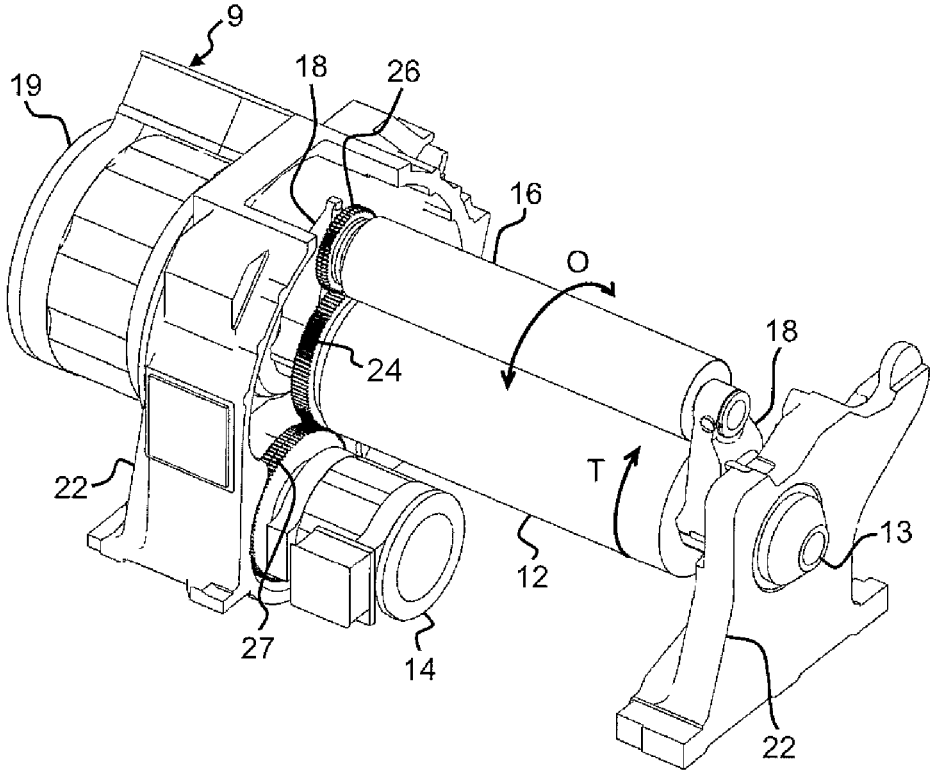
FIG. 2 represents a partial view in perspective of a feeding device that is present in the feeding station of FIG. 1.
Figure 3:
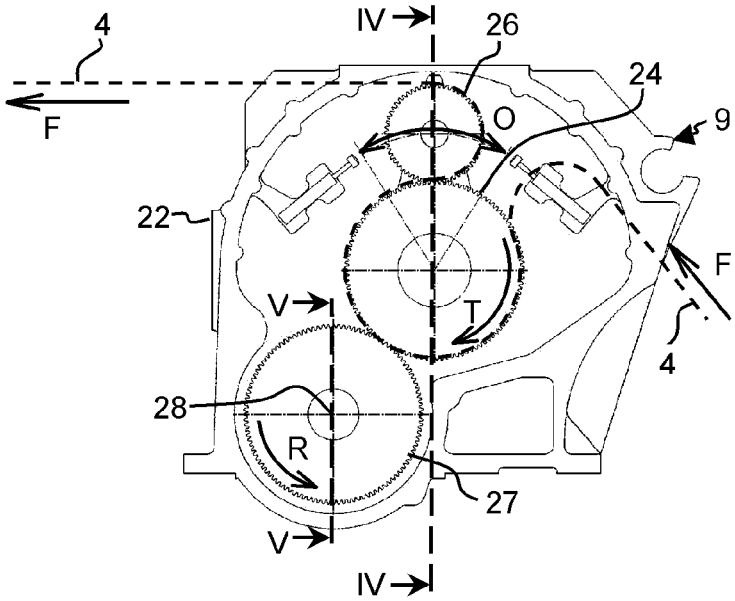
FIG. 3 shows a partial side view of the device of FIG. 2.
Figure 4:
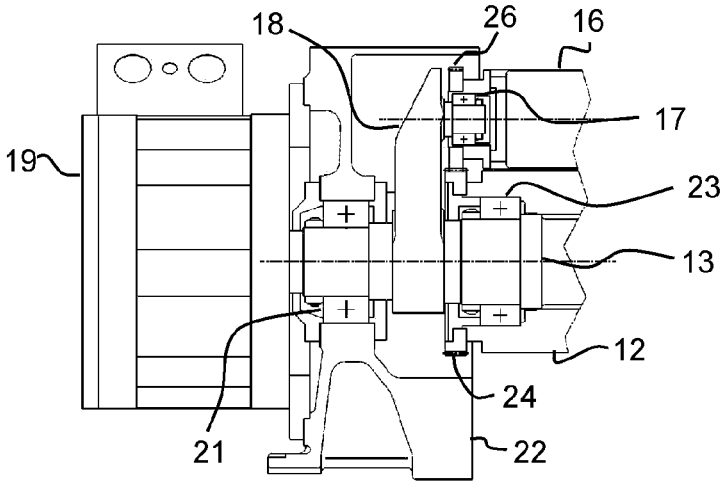
FIG. 4 shows a view in partial section along the vertical plane IV-IV of the device of FIG. 3.
Figure 5:
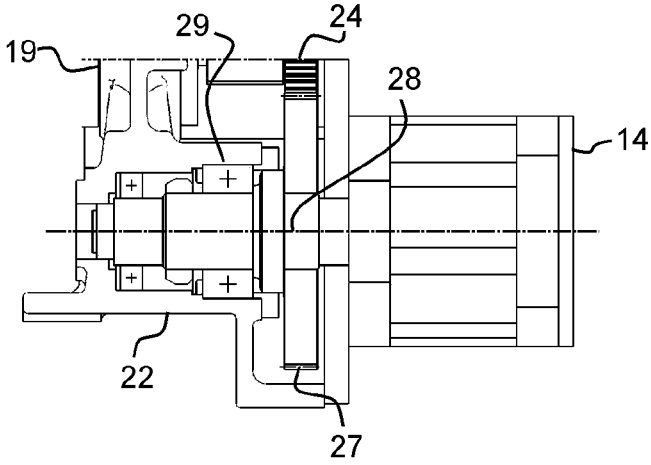
FIG. 5 shows a view in partial section along a vertical plane V-V of the device of FIG. 3.

According to the invention, the device (9) comprises a main drive roller (12) rotating (arrow T in FIGS. 1, 2 and 3) on a main shaft (13). The main shaft (13) and therefore the main roller (12) are mounted substantially horizontally and perpendicularly to the direction of progression of the web (4). The main roller (12) therefore continuously drives the web (4) from upstream to downstream. A main electric drive motor (14) rotates (T) the main drive roller (12).

A satellite roller (16) is mounted by being coupled parallel to the main roller (12). The web (4) is engaged between the main roller (12) and the satellite roller (16) and it is maintained there while being able to be driven (F) in the forward direction (see also the path that can be seen in dashed lines in FIGS. 1 and 3). The web (4) forms a path which makes approximately three-quarters of a circumference of the main roller (12) and half a circumference of the satellite roller (16).

The satellite roller (16) is able to oscillate (arrow O in FIGS. 1, 2 and 3) about the main drive roller (12), from upstream to downstream, and vice versa from downstream to upstream. Two extreme positions of the satellite roller (16) are shown in dotted lines in FIG. 1.

The frequency of the oscillations (O) of the satellite roller (16) generates variations of the speed of web (4). The web (4) can change cyclically from a constant speed (F) to a zero speed, and vice versa from a zero speed to a constant speed (F). These speed variations and therefore the frequency of the oscillations (O) are chosen according to the cutting strike speed of the press (3) situated downstream.

Moreover, the angular amplitude of the oscillations (O) of the satellite roller (16) generates different lengths of web (4) to be infed into the press (3). These lengths and consequently the angular amplitude of the oscillations (O) are chosen according to the size to be cut by the press (3) placed downstream. As an indication, the angular amplitude varies from ±9° to ±24°.

The satellite roller (16) rotates in two satellite bearings (17). The two satellite bearings (17) are located at each of the ends of the satellite roller (16). The two satellite bearings (17) are each inserted into two lateral levers (18) thus located at each of the ends of the satellite roller (16).

The two lateral levers (18) are mounted on and joined to the main shaft (13). The main shaft (13) is designed in a similar manner to a stiffening or antitorsion bar or crossmember, so as to withstand the considerable stresses due to the oscillations (O) and to the weight of the satellite roller (16) and of the two lateral levers (18). The weight in motion is thus reduced because it is placed directly on the oscillation axis (O).

This antitorsion crossmember is placed as close as possible to the rotation axis, thus preventing other offset inertias. The main shaft (13), the two lateral levers (18) and the satellite roller (16) are driven from only one or both ends with very little skewing of the satellite roller (16). The device (9) is very rigid with a low inertia in motion.

The device (9) comprises at least one secondary electric drive motor (19) able to cause the main shaft (13), the two lateral levers (18) and the satellite roller (16) to oscillate. The secondary motor or motors (19) may preferably be mounted coaxially with the main shaft (13). Advantageously, the rotor of the secondary motor (19) may be joined to the main shaft (13). The stator of the secondary motor (19) may be secured to the frame (22). This simplified construction allows the elimination of static indeterminacy and the further reduction of the number of rolling bearings.

In another embodiment, the device (9) may comprise two secondary motors which may be able to rotate the main shaft (13), the two lateral levers (18) and the satellite roller (16). These two secondary motors may be arranged at each of the two ends of this main shaft (13). This solution is advantageous for preventing a skewing of one side of the main shaft (13) relative to the other side.

The main shaft (13) rotates in two shaft bearings (21). The two shaft bearings (21) are located at each of the ends of the main shaft (13). The two shaft bearings (21) are each inserted into a lateral face of the frame (22).

The main drive roller (12) rotates in two main bearings (23). The two main bearings (23) are situated at each of the ends of the main drive roller (12). The two main bearings (23) are each inserted onto the main shaft (13).

With the device (9), the aerodynamic features associated with the path of the web (4) around the main roller (12) and the satellite roller (16) are improved. The web (4) is kept pressed against the main roller (12) and the satellite roller (16). There is no longer any free or floating length of web (4) in the device (9). With the device (9), the variations in tension of the web (4) have been greatly reduced. The design of the device (9) also allows the reduction of the length of free web (4) between the device (9) and the modulated infeed roller (11).

The main drive roller (12) may advantageously have a main toothed wheel or ring gear (24) arranged at one of its ends. Favorably, the satellite roller (16) may also have a satellite toothed wheel or ring gear (26) arranged at one of its ends. This satellite ring gear (26) meshes with the main ring gear (24).

The advantage of these ring gears (24 and 26) is that the disruptions associated with the inertia of the satellite roller (16), which accelerates and decelerates, are absorbed by the driving of the main drive roller (12) and are therefore not transmitted to the web (4).

The main electric drive motor (14) may advantageously have a pinion (27) and rotate it (arrow R in FIG. 3) via its drive shaft (28). The drive shaft (28) is held by and rotates in a bearing (29). This pinion (27) meshes with the main ring gear (24) which rotates (T) the main drive roller (12). In this manner, the driving of the main drive roller (12) is offset radially in a cascade of gears (24 and 27) and allows the antitorsion crossmember to pass through the main drive roller (12) in the form of the main shaft (13). In the main embodiment, the cascade of gears (24, 26 and 27) and the motors (14 and 19) are placed "opposite operator's side," that is to say on the right, with respect to the direction of progression of the web (4), along the longitudinal direction.

The device (9) may very preferably also comprise a pressure roller (31) positioned against the main drive roller (12). The web (4) is thus additionally maintained by this pressure roller (31).

The present invention is not limited to the embodiments described and illustrated. Many modifications can be made without departing from the context defined by the scope of the set of claims.

The invention claimed is:

1. A device for feeding a web substrate to a converting unit, the converting unit for converting the web substrate when stopped, the device comprising:

a main drive roller rotating in a first direction on a main shaft, the main drive roller being rotatably mounted on the main shaft, a main electric drive motor rotating the main drive roller, a satellite roller which is configured and operable to oscillate about the main drive roller, from upstream to downstream, and vice versa with respect to the first direction, two lateral levers holding the satellite roller, and mounted on and joined to the main shaft, and at least one secondary electric drive motor which is configured and operable to oscillate the main shaft, the two lateral levers and the satellite roller, the main drive roller and the satellite roller being positioned and configured to engage and maintain the web substrate between them, and configured and operable to change a speed of the web substrate cyclically from a constant speed to a zero speed at an exit region of the satellite roller, and vice versa.

2. A device for feeding a web substrate to a converting unit, the converting unit for converting the web substrate when stopped, the device comprising:

a main drive roller rotating in a first direction on a main shaft, a main electric drive motor rotating the main drive roller, a satellite roller which is configured and operable to oscillate about the main drive roller, from upstream to downstream, and vice versa with respect to the first direction, two lateral levers holding the satellite roller, and mounted on and joined to the main shaft, and at least one secondary electric drive motor which is configured and operable to oscillate the main shaft, the two lateral levers and the satellite roller, the main drive roller and the satellite roller being positioned and configured to engage and maintain the web substrate between them, and configured and operable to change a speed of the web substrate cyclically from a constant speed to a zero speed at an exit region of the satellite roller, and vice versa, wherein the secondary electric drive motor is mounted coaxially with the main shaft.

3. A device for feeding a web substrate to a converting unit, the converting unit for converting the web substrate when stopped, the device comprising:

a main drive roller rotating in a first direction on a main shaft, a main electric drive motor rotating the main drive roller, a satellite roller which is configured and operable to oscillate about the main drive roller, from upstream to downstream, and vice versa with respect to the first direction, two lateral levers holding the satellite roller, and mounted on and joined to the main shaft, and at least one secondary electric drive motor which is configured and operable to oscillate the main shaft, the two lateral levers and the satellite roller, the main drive roller and the satellite roller being positioned and configured to engage and maintain the web substrate between them, and configured and operable to change a speed of the web substrate cyclically from a constant speed to a zero speed at an exit region of the satellite roller, and vice versa, the main shaft, the two lateral levers and the satellite roller, wherein the secondary electric drive motor has a rotor that is joined to the main shaft.

4. The device according to claim 1, wherein the at least one secondary electric drive motor comprises two secondary electric drive motors which are configured and operable to rotate the main shaft and arranged at each of the two ends of the main shaft.

5. The device according to claim 1, further comprising a ring gear arranged at one end of the main drive roller.

6. The device according to claim 5, further comprising a ring gear arranged at one end of the satellite roller and meshing with the ring gear of the main drive roller.

7. The device according to claim 6, further comprising a pinion of the main electric drive motor meshing with the ring gear of the main drive roller.

8. The device according to claim 1, further comprising a pressure roller positioned against the main drive roller.

9. A station configured and operable for feeding to a converting unit a web substrate, the station including a device according to claim 1, the converting unit converting the web substrate when stopped.

10. The station according to claim 9, further comprising, from upstream to downstream with respect to the first direction, a lateral web guidance, a dancer roller for maintaining web tension, a substrate straightener for the web substrate, and a modulated infeed roller.

11. A machine for producing packages, comprising a station according to claim 9, positioned upstream from the converting unit along the path of the web substrate, the converting unit being in the form of a diecutting platen press.

12. The device according to claim 5, further comprising a pinion of the main electric drive motor meshing with the ring gear of the main drive roller.

13. A machine for producing packages, comprising a station according to claim 10, positioned upstream from the converting unit along the path of the web substrate, the converting unit being in the form of a diecutting platen press.

* * * * *